US008240005B2

(12) United States Patent
Hufen

(10) Patent No.: US 8,240,005 B2
(45) Date of Patent: Aug. 14, 2012

(54) REGULATING VALVE OF A HYDRAULIC DOOR CLOSER

(75) Inventor: Michael Hufen, Wuppertal (DE)

(73) Assignee: Dorma GmbH & Co. KG, Ennepetal (DE)

( * ) Notice: Subject to any disclaimer, the term of this patent is extended or adjusted under 35 U.S.C. 154(b) by 254 days.

(21) Appl. No.: 12/667,091

(22) PCT Filed: Jun. 9, 2008

(86) PCT No.: PCT/EP2008/004570

§ 371 (c)(1),
(2), (4) Date: Dec. 29, 2009

(87) PCT Pub. No.: WO2009/003570

PCT Pub. Date: Jan. 8, 2009

(65) Prior Publication Data

US 2010/0192325 A1 Aug. 5, 2010

(30) Foreign Application Priority Data

Jun. 29, 2007 (DE) ..... 20 2007 009 174 U

(51) Int. Cl.
*E05F 3/22* (2006.01)

(52) U.S. Cl. ..... 16/51; 16/49; 16/52; 16/71; 16/DIG. 9; 16/DIG. 17; 16/DIG. 21

(58) Field of Classification Search ..... 16/51, 49, 16/52, 56–58, 71, DIG. 9, DIG. 17, DIG. 21; 49/70, 137; 137/596, 505, 513.3, 513.5, 137/513.7, 599.09, 599.03, 599.18, 41, 505.27; 251/366, 367, 357, 368, 903, 215–217, 123, 251/122

See application file for complete search history.

(56) References Cited

U.S. PATENT DOCUMENTS

| | | | | |
|---|---|---|---|---|
| 4,148,111 | A | 4/1979 | Lieberman | |
| 4,386,446 | A * | 6/1983 | Zunkel et al. | 16/58 |
| 4,425,939 | A * | 1/1984 | Marinoni et al. | 137/599.18 |
| 4,573,238 | A * | 3/1986 | Phillips | 16/79 |
| 4,825,503 | A * | 5/1989 | Shiramasa et al. | 16/52 |
| 5,414,894 | A * | 5/1995 | Fayngersh | 16/52 |
| 6,073,649 | A * | 6/2000 | Somorov | 137/505.41 |
| 6,112,368 | A * | 9/2000 | Luckett | 16/59 |
| 2006/0196008 | A1 * | 9/2006 | Karkkainen | 16/71 |
| 2008/0229543 | A1 * | 9/2008 | Juntunen | 16/84 |

FOREIGN PATENT DOCUMENTS

| | | |
|---|---|---|
| DE | 10228872 | 1/2004 |
| DE | 202007004104 U1 | 6/2007 |
| EP | 0562460 | 9/1993 |

* cited by examiner

*Primary Examiner* — Chuck Y. Mah
(74) *Attorney, Agent, or Firm* — Cozen O'Connor

(57) ABSTRACT

The invention relates to a regulating valve, which is attachable in particular in a bore, executed with a female thread, of a hydraulic door closer. The regulating valve has a body adjoined by a regulating area. The regulating valve also has a thread provided with an anti-rotation element. The thread, including the anti-rotation element, being screwed into the female thread of the bore. In order to provide a regulating valve of a simple design, in which any unwanted adjustment of the regulating valve during operation is excluded, the anti-rotation element of the regulating valve has a plastic material layer at the thread flanks of the thread. The plastic material layer cooperates with the female thread of the door closer.

16 Claims, 3 Drawing Sheets

REGULATING VALVE OF A HYDRAULIC DOOR CLOSER

CROSS REFERENCE TO RELATED APPLICATIONS

This is a U.S. national stage of International Application No. PCT/EP2008/004570 filed Jun. 9, 2008, claiming priority to German Application No. 20 2007 009 174.5 filed Jun. 29, 2007, the entire contents of both applications being expressly incorporated herein by reference.

BACKGROUND OF THE INVENTION

1. Field of the Invention

The invention relates to a regulating valve, which is attachable in particular in a bore, executed with a female thread, of a hydraulic door closer.

2. Description of the Related Art

DE 102 28 872 B4 discloses a regulating valve for a door closer, which consists of a body and of a regulating area. For the purpose of regulating the regulating valve, the body has a thread which can be screwed into a bore of the door closer. In this case, the regulating area is executed in a bush-shape and connected to the body via a ball-joint connection. In order to avoid any unwanted rotation of the regulating valve, in particular of the regulating area, an anti-rotation means is provided, which is disposed at the regulating area and is formed as an extension or as a projection. This extension is longitudinally guided in a groove within the housing of the door closer.

SUMMARY OF THE INVENTION

It is an object of the present invention to provide a regulating valve of the species described in the introduction, wherein the regulating valve has a simple design and can avoid unwanted adjustment of the regulating valve during operation.

According to the invention, it is provided that the anti-rotation means presents a plastic material layer at the thread flanks of the regulating valve, which layer cooperates with the female thread of the door closer. Thereby a clamping effect is achieved, which prevents the regulating valve from an unintentional releasing or rotation.

Another improvement is achieved in that the body has a thread with a plastic material layer being disposed in its thread flanks. Thereby, the thread shape, which is provided with the plastic material layer in a process, is predetermined at the body.

It has proven to be practical to dispose the thread at the shank of the body. Thereby, the production of the thread can be realized in a simple manner.

Another improvement is provided in that the regulating area comprises a shank prolongation with an end, wherein the shank prolongation is connected via a material guide to the plastic material layer in the thread flanks of the thread at the regulating valve. Thus, the regulating area can be produced in a single operation.

Another substantial advantage is that the body has a pocket hole bore, which is disposed along the longitudinal axis of the body, opposite the head area. Thereby, the regulating area can be produced as one piece, non-positively or positively connected as well as aligned to the body.

It is furthermore advantageous that the pocket hole bore has an angular or non-circular cross-section. This provides an additional protection against rotation when screwing the regulating valve into the bore of the door closer.

It is again advantageous that the extension is positively and in a rotation-resistant manner fastened in the pocket hole bore. The regulating area is thus connected to the body in a stabilized manner.

Furthermore, it has been proven to be advantageous that the extension has at least one neck which projects into a bore of the body. Thereby the plastic material is guided towards the thread flanks and the extension is additionally secured against rotation.

It is an advantage that the plastic material layer is disposed at the thread positively and/or non-positively and/or adhesively by material. Thereby, the clamping effect can be very fine tuned, because the plastic material layer engages directly in the corresponding thread on the body and, at this location, in the thread flanks of the door closer when the regulating valve is used in the door closer. This generates a high surface pressure between the thread flanks of the female thread and the thread flanks of the regulating valve. It has been demonstrated that, due to such a disposition, the engaging thread parts can no longer rotate independently. Furthermore, a manual and/or intentional adjustment of the regulating valve is obviously still possible. In other words, the regulating valve can be adjusted at any time according to the specific requirements of a defined closing behavior, the anti-rotation means effectively preventing any independent rotation, in particular that caused by occurring dynamic stresses.

The regulating area has an end facing away from the body and being tapered, preferably cone-shaped. This embodiment offers a more precise adjustment of the oil flow, which considerably influences the closing speed of the closing operation. Despite the forces, which are originated by the flowing fluid, acting upon the regulating valve, the plastic material layer at the thread flanks of the regulating valve ensures that the regulating valve does not re-adjust accidentally and independently in the thread.

It has been proven to be advantageous that the regulating area is attached at the body by an injection molding process. Thereby, the regulating area is produced in a simple mode of operation. Depending on the requirements with regard to the material to be processed, the injection molding process can be modified. The body may be made from metal, for example zinc, brass or steel, the regulating area being preferably made from plastic material. In order to achieve in particular a high strength, the plastic material may be reinforced by fibers; in particular, the plastic material may have a certain percentage of glass fibers and/or carbon fibers and/or aramid fibers.

Another possibility is that the body and/or the regulating area consists of a plastic material, in particular the body comprising a fiber-reinforced plastic material. Thereby, the whole regulating valve can be manufactured in single operation.

Another advantage turns out to be color coding the body, thereby, different types of regulating valves can be visually distinguished.

It is advantageous that the door closer has a supply channel, a drainage channel and a cone-shaped valve seat, a fluid being able to be conducted through the supply channel along the valve seat and to the drainage channel. The free end of the regulating area is substantially adapted to the valve seat of the door closer. As a rule, there is a certain distance between the valve seat and the preferably cone-shaped end of the regulating area, such that the fluid from the supply channel can flow between the valve seat and the preferably cone-shaped end of the regulating area into the direction of the drainage channel.

BRIEF DESCRIPTION OF THE DRAWINGS

In the drawings:

FIG. 5 shows a door closer, the regulating valve being screwed-in.

DETAILED DESCRIPTION OF EMBODIMENTS

Figure 1:
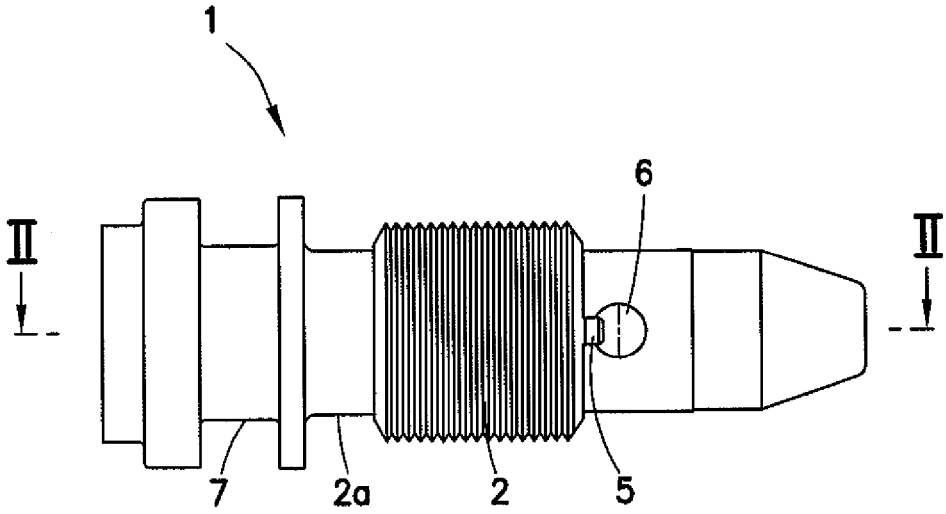
FIG. 1 shows an inventive regulating valve in a plane view.

FIG. 1 shows a regulating valve 1, which is provided for a hydraulic door closer. In this case, various door closers may be considered, which for example can be operated by an eccentric cam disc according to DE 103 61 085 A1 or by a toothed rack according to DE 199 01 234 C1. The regulating valve 1 has a reception 7 for a sealing element. This sealing element may consist for example of an O-ring. The shank 2*a* of the regulating valve 1 has a thread 2, a plastic material layer being provided in the thread flanks. The material exit opening 6 as well as the material guide 5 is mounted at the regulating valve 1. Furthermore, FIG. 1 presents a sectional plane II-II.

Figure 2:
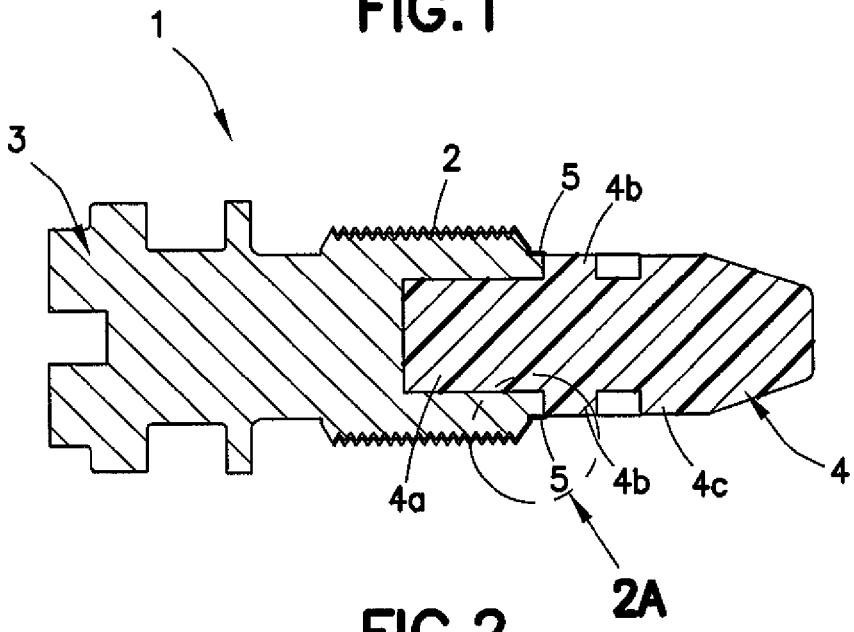
FIG. 2 shows the inventive regulating valve of FIG. 1 in a full section along the sectional plane II-II.

FIG. 2 shows a full section through the regulating valve 1 along the sectional plane II-II of FIG. 1. The regulating valve 1 consists of a body 3, as well as of a regulating area 4. The regulating area 4 essentially consists of a shank prolongation 4*c* and of an extension 4*a*. Furthermore, necks 4*b* are illustrated, which, through the material guide 5, form the plastic material layer at the thread 2.

Figure 2A:
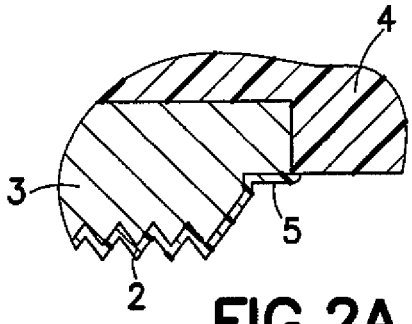
FIG. 2*a* is a detailed view of the thread and the body of FIG. 2.

FIG. 2*a* is a detailed view of the thread of the body with the antirotation means on the flanks of the threads. The regulating valve 1 has a thread 2 and a plastic material layer being provided in the thread flanks.

Figure 3:
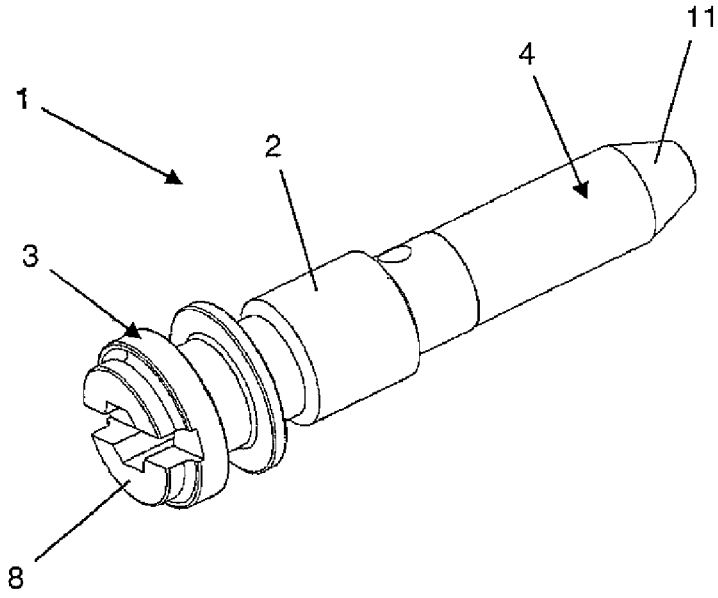
FIG. 3 shows the inventive regulating valve of FIG. 1 in a perspective view.

FIG. 3 shows a regulating valve 1 of FIG. 1 in a perspective view. A head area 8, which the mechanic uses to operate the regulating valve 1 with an appropriate tool, is fitted to the body 3. In FIG. 3, the thread 2 is diagrammatically illustrated for the sake of simplicity. The free end 11 of the regulating area 4 is cone-shaped and tapered.

Figure 4:
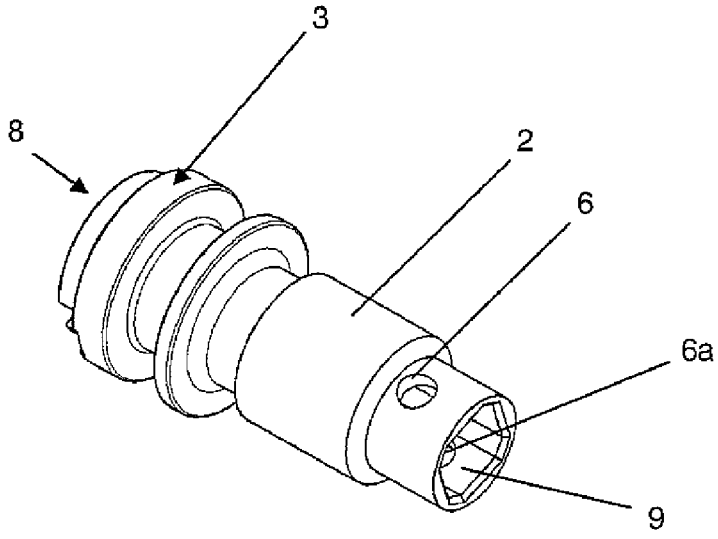
FIG. 4 shows the body of the inventive regulating valve of FIG. 3.

FIG. 4 shows the body 3 in a perspective view. In this case, the thread 2 is diagrammatically illustrated for the sake of simplicity. On the side of the body 3 opposite the head area 8, the body 3 has a pocket hole bore 9. The pocket hole bore 9 may have, for example a rectangular, square or triangular cross-section. Furthermore, material exit openings 6 and 6*a* are illustrated which continuously extend as far as into the positive pocket hole bore 9.

Figure 5:
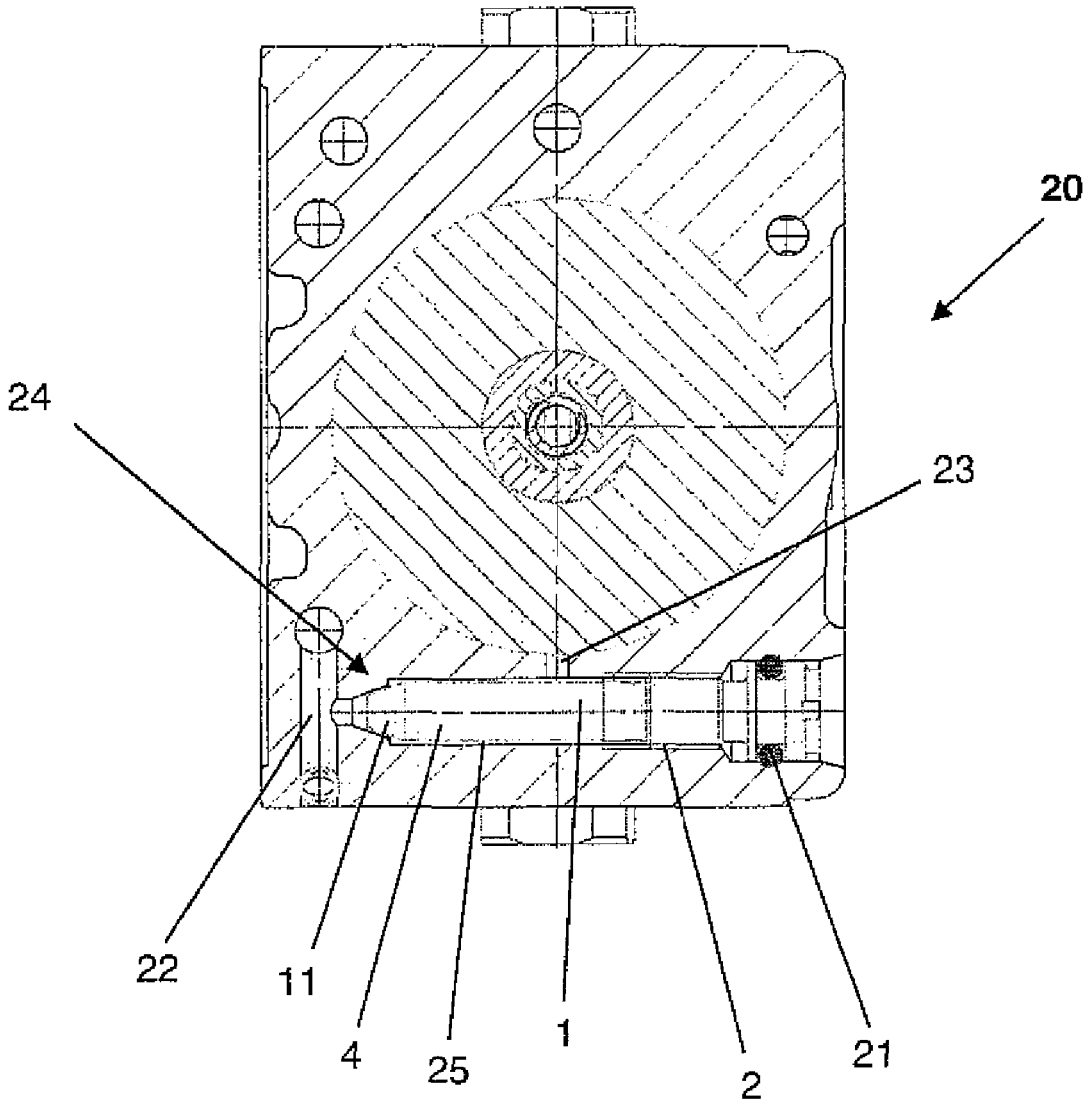

FIG. 5 shows a door closer 20 into which a regulating valve 1 is screwed. In this case, the thread 2 with the plastic material layer corresponds to the female thread 25 of the door closer 20. The regulating valve 1 has a sealing element 21. The free end 11 of the regulating area 4 and thus of the regulating valve 1 is located in a cone-shaped valve seat 24 of the door closer 20. A supply channel 22, through which oil is conducted, is located in the region of the cone-shaped free end 11 of the regulating area 4. As a rule, the cone-shaped free end 11 of the regulating area 4 does not directly bear against the valve seat 24, such that the oil can flow through the small channel, formed between the valve seat 24 and the cone-shaped free end 11 of the regulating area 4, into the direction of a drainage channel 23. The flow cross-section for the oil can be adjusted at the regulating valve 1, whereby in particular the closing behavior of the door closer 20 is controllable. On account of the above described anti-rotation means, the forces, produced by the flowing oil and acting upon the regulating valve 1, are unable to cause any unwanted rotation of the regulating valve 1, not even in the tolerance range.

The above described regulating valve 1 is produced as follows. Initially the body 3 is produced in the shape according to FIG. 4 with a thread 2 on the shank of the body 3. The body 3 is inserted into operating means, preferably an injection molding tool. In an injection operation, in which a plastic material is processed, the regulating area 4 is formed by the injection moulding tool. In this case, the plastic material layer is formed at the thread 2 through the material exit openings 6 and 6*a*, as well as the material guide 5. During the injection operation, a plastic material is used, which is a polyacetal (POM) in the present embodiment, distinguished among others things by excellent sliding characteristics, good resistance to chemicals and high abrasion resistance.

For clarity's sake, the illustration of the operating means has been omitted.

On account of this process, the regulating area 4 is non-positively and/or positively connected to the body 3, and thus the regulating valve 1 according to FIG. 1 is obtained.

A clamping effect between the thread 2 of the regulating valve 1 and the female thread 25 of the door closer 20 is achieved on account of the plastic material layer at the thread flanks, because the space between the threads is filled. Thereby a higher surface pressure of the engaging thread parts is obtained. At the same time, the regulating valve 1 can be manually rotated at any time and/or be unscrewed from the bore of the door closer 20.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A regulating valve, which is attachable in a threaded bore of a hydraulic door closer, the regulating valve comprising:

a body adjoined at a first side by a regulating area, and a thread arranged on an outer circumference of the body provided with an anti-rotation means, the thread and the anti-rotation means being threadably receivable in the threaded bore, wherein the anti-rotation means comprises a plastic material layer and is disposed at thread flanks of the thread, and a pocket hole bore arranged axially in the first side of body and having an angular or non-circular cross-section.

2. The regulating valve according to claim 1, wherein the thread is disposed at a shank of the body.

3. The regulating valve according to claim 1, wherein the regulating area comprises a shank prolongation with an end, the shank prolongation being connected to the plastic material layer at the thread flanks of the thread via a material guide.

4. The regulating valve according to claim 1, wherein the pocket hole bore is disposed along a longitudinal axis of the body.

5. The regulating valve according to claim 4, further comprising an extension of the regulating area positively and rotation-resistantly connected in the pocketed bore hole.

6. The regulating valve according to claim 3, wherein the regulating area has an end which faces away from the body and is cone-shaped.

7. The regulating valve according to claim 1, further comprising an extension of the regulating area positively and rotation-resistantly connected in the pocket bore hole.

8. The regulating valve according to claim 7, wherein the extension has at least one neck that protrudes into a material exit opening at the first end of the body.

9. The regulating valve according to claim 1, wherein the plastic material layer is disposed at the thread at least one of positively, non-positively, and adhesively by a material.

10. The regulating valve according to claim 1, wherein the regulating area has an end which faces away from the body and is tapered.

11. The regulating valve according to claim 1, wherein the regulating area is molded to the body.

12. The regulating valve according to claim 1, wherein at least one of the body and the regulating area comprises a plastic material.

13. The regulating valve according to claim 1, wherein the body is colored.

14. The regulating valve according to claim 1, wherein the body comprises a fiber-reinforced plastic material.

15. A door closer comprising:

a valve bore;

a regulating valve of claim 14 threadably received in the valve bore;

a supply channel; and a drainage channel fluidly communicated with the valve bore;

wherein the valve bore is formed with a female thread engaging with the thread on the body of the regulating valve, whereby a fluid can be supplied from the supply channel to the drainage channel.

16. The door closer according to claim 15, further comprising a cone-shaped valve seat in fluid communication with the supply channel and the valve bore, wherein the cone-shaped valve seat receives a cone-shaped end of the regulating valve;

whereby the fluid can flow through a channel between the cone-shaped valve seat and the cone-shaped end of the regulating valve to the drainage channel.

* * * * *